US005596158A

United States Patent [19]

Tonon

[11] Patent Number: 5,596,158

[45] Date of Patent: Jan. 21, 1997

[54] THREE-PAINT SUSPENSION OF MUSICAL INSTRUMENTS

[76] Inventor: Thomas S. Tonon, 35 Birch Ave., Princeton, N.J. 08542

[21] Appl. No.: 454,017

[22] Filed: May 30, 1995

Related U.S. Application Data

[63] Continuation-in-part of Ser. No. 754,588, Sep. 4, 1991, abandoned.

[51] Int. Cl.[6] ..... G10D 3/00; G10G 5/00

[52] U.S. Cl. ..... 84/327; 224/910; 224/258

[58] Field of Search ..... 84/327; 224/910, 224/202, 258, 257

[56] References Cited

U.S. PATENT DOCUMENTS

| | | | |
|---|---|---|---|
| D. 306,871 | 3/1990 | Bracy | 84/327 |
| 4,254,901 | 3/1981 | McIntosh | 84/327 |
| 4,279,367 | 7/1981 | Jacobs | 84/327 |
| 4,656,917 | 4/1987 | Van Halen | 84/327 |
| 4,930,695 | 6/1990 | Thompson et al. | 84/327 |

*Primary Examiner*—Cassandra C. Spyrou
*Attorney, Agent, or Firm*—George E. Kersey, Esq.

[57] ABSTRACT

A three-point harness strap for suspending a musical instrument which has a main body and an extension, with a first connector for attaching the strap to the main body of the instrument, a second connector for attaching the strap to the extension of the instrument from its main body, and a third connector between the first and second connectors and for attachment to the instrument between its main body and extension for limiting the extent to which the strap can be displaced from the body of the instrument.

18 Claims, 3 Drawing Sheets

THREE-PAINT SUSPENSION OF MUSICAL INSTRUMENTS

This is a continuation-in-part of Ser. No. 07/754,588 filed Sep. 4, 1991 now abandoned.

BACKGROUND OF THE INVENTION

The invention relates to the suspension of musical instruments, and more particularly, to the suspension of stringed instruments, such as guitars, which have an unbalanced center of mass.

Large stringed instruments, such as guitars, which are commonly suspended about the shoulder of the musician, are held by a harness, which often has both of its ends attached to the main body of the instrument.

In many modern stringed instruments, such as guitars, there is an elongated neck that extends from the body of the instrument and terminates in a head pad with laterally protruding keys or knobs by which the strings can be adjusted. Because the head pad tends to be enlarged for aesthetic and utilitarian reasons, it applies a substantial amount of torque to the main body of the instrument through the elongated neck, when both ends of the harness are attached to the main body, resulting in an imbalance. Thus, the guitar player generally has to apply pressure with his arm to the base of the guitar near where the harness is attached, in order to balance the instrument.

In another common method of suspending large instruments, such as guitars, by a shoulder harness, one end of the harness is attached to the main body of the instrument, and the other end of the harness is attached to a head pad, which is attached to the main body by an elongated neck. With such suspension, the instrument tends to rest with its center of gravity directly below the region where the harness contacts the shoulder of the musician. With instruments having very long necks, such suspension causes the active playing area of the instrument to lie out of convenient reach of the musician. The musician must then apply a force to the instrument in order to swing the active playing area of the instrument to a convenient position. A further disadvantage of such suspension for relatively heavy instruments is the length the harness must traverse, and the necessarily small angle the harness makes with the neck of the instrument. These result in a loose and insecure positioning of the instrument with respect to the musician. The harness tends to slip from the shoulder of the musician, and the musician must continually adjust the position of the instrument.

In the illustrative prior art of the parent application, Jacobs discloses a strap attached to the main body of a guitar at a first anchor point by combined fittings. A further fitting is joined to the guitar at a second anchor point, with an intermediate buckle adjustment, unconnected to the guitar, for controlling the extent to which the strap can be displaced from the body of the guitar.

In the further illustrative prior art of Van Halen, a suspension that includes a strap is attached at the body and neck of a guitar, and at an intermediate support. The strap has a first attachment to the main body of the guitar and a second attachment to the head. A further attachment is intermediate the first and second attachments displaced from the first attachment, but not attached in the vicinity where the guitar body is connected to the neck.

Accordingly, it is an object of the invention to facilitate the suspension of musical instruments. A related object is to facilitate the suspension of stringed instruments, such as guitars with long necks.

A further object of the invention is to facilitate the suspension of musical instruments which tend to be unbalanced or insecure in their conventional suspension.

Another object of the invention is to improve over the suspensions of the prior art, including Jacobs and Van Halen.

SUMMARY OF THE INVENTION

In accomplishing the foregoing and related objects, the invention provides for the suspension of musical instruments, each having a main body and an extension from the main body, by a strap that is attached at one extremity of the main body, and is further attached to the extension from the main body. An intermediate attachment between the main body and the extension limits the extent to which the strap can be displaced from the body of the instrument.

In accordance with one aspect of the invention, the intermediate attachment is fixed to the strap, or looped about the strap, between the strap end that is attached to the extension from the main body and the strap end that is attached to the end portion of the main body opposite the extension. The intermediate attachment is adjustable, for example, in length. Its position of contact with the strap is also adjustable.

In accordance with another aspect of the invention, the instrument is a guitar having a main body and a neck extending from the main body to a terminal head end, and the strap is attached at one end to the head of the instrument and at the other end to a portion of the main body remote from the head end. The intermediate attachment is to the main body in the vicinity of the connection of the main body to the neck. The strap desirably has a thickness which is less than its width and is removably attached to the instrument.

In a method according to the invention, of balancing an instrument with respect to the body of a player, the steps include (a) attaching to the instrument a three-point harness formed by a strap and an intermediate attachment; and (b) positioning a portion of the strap on the body of the player. The strap is positioned to achieve a balanced orientation of the instrument without requiring the need for applying a countervailing torque to the instrument. When the instrument is a guitar, the strap of the harness extends about the neck of the player and rests on the shoulder, in the vicinity of the collar bone. The method can include the further step of adjusting the strap in relation to its intermediate connection to the instrument. The adjustment can be made using the intermediate attachment to the strap, forming an intermediate connection that is either fixed to the strap at selectable positions, or is looped about the strap at the intermediate position. Both the length of the intermediate attachment and the location of its contact with the strap can be adjusted as needed to achieve balance and security of the instrument relative to the player.

In a combination according to the invention of a musical instrument and a suspension for the instrument, the instrument has centers of mass separated by an intervening connection, and the suspension has an attachment to each center of mass and a further attachment intermediate opposite centers of mass. The intervening connection can be an elongated neck, with the further attachment between one center of mass and the elongated neck. One center of mass can be a main body and the other center of mass be a head member affixed at one end to the elongated neck.

When the musical instrument is a guitar with a main body joined to a head end by a stringed neck, the suspension is by a strap with one end attached to the main body, with the opposite end attached to the head end, and an intermediate portion of the strap attached in the vicinity of where the stringed neck attaches to the main body. The end of the strap attached to the main body can be at the extremity thereof most remote from the head end, and the end of the strap attached to the head end can be in the vicinity of the junction of the head and the elongated neck. The intermediate portion of the strap is attached near the junction of the stringed neck and the main body by an intermediate attachment, which consists of a fixed connection, or a loop encircling the strap at the intermediate position.

The length of the intermediate connection and its position of contact to the strap can be adjustable, or its contact to the strap is facilitated by the use of a loop.

Van Halen discloses a strap attached at the body and neck of a guitar and at an intermediate support, but in one aspect of the invention there is a strap attached to each of opposite centers of mass, and a further attachment connected and confined to the strap between the opposite centers of mass. The support in Van Halen is not so confined; instead, the support extends from the backside of the body.

The further attachment of the invention can be connected to the instrument and to the suspension means. In this combination, one center of mass is a main body, and the other center of mass is a head affixed at one end to an elongated neck. Such a combination can be a guitar with a resonant chamber joined to a head by a stringed neck, and the further attachment supports the instrument in tension, not in compression, as disclosed by such prior art, as Van Halen.

In Van Halen, the disclosure is of a shelf-like item attached to the bottom of a guitar with no suggestion that this could be substituted by a strap or harness. In addition, the intermediate support in Van Halen is by a rigid hinged shelf from below, applying compressive stresses to the instrument. The invention, on the other hand, has support by tension in a harness pulling from above at the intermediate attachment. For the invention, the attached members are joined together, whereas in Van Halen the shelf is separated from the strap.

The intermediate member of the invention restricts motion of the body of the guitar by clamping it to a strap, whereas the shelf in Van Halen does not contact a strap. Moreover, the purpose in Van Halen is to hold the body of a guitar at a right angle to the player, whereas the invention provides for holding the guitar parallel to the body of a player with the neck of the instrument at a fixed convenient angle.

For the invention, a strap for the suspension of a musical instrument is attached by a first member to a main body of the instrument, by a second member to an extension from the main body, with a member intermediate the first and second members for attachment to the instrument between the main body and the extension, the purpose being for limiting the extent to which the strap can be displaced from the body of the instrument. This is not in the prior art, such as Van Halen.

Where the instrument is a guitar, the strap has opposite ends attached at one end to the head and at the other end to a portion of the main body remote from the head end. The intermediate member which limits strap displacement is attached to the main body in the vicinity of a connection of the main body to the neck. This is not in the prior art, such as Van Halen.

For one aspect of the invention, a harness has an attachment to each of opposite centers of mass of an instrument and a further attachment connected and confined between the opposite centers of mass. The support in the prior art such as Van Halen is not confined between opposite centers of mass.

While the prior art such as Jacobs discloses three distinctive points of attachment, the points are not at separated positions on the instrument. The invention, by contrast, requires the use of three separate and distinctive anchor points in relation to the instrument used with a harness.

When consideration is given to how the respective harnesses of prior art, such as Jacobs, and the invention are used in conjunction with a musical instrument, the significance of the differences becomes apparent.

The teaching in Jacobs requires the suspension of an object only between first and second spaced points of support. There is no suggestion whatsoever in Jacobs of three separate points of support on an instrument. In addition, the second strap segment of Jacobs is "sized to wrap completely around" the torso of a user. Such sizing would completely defeat the invention. In Jacobs the total length of his harness is about seven feet, which could not suggest the much shorter length that can be employed for the invention.

Moreover, in the Jacobs method, the second strap segment is wrapped across the stomach, around the back and across the chest to form a complete loop around the torso of the player. The invention could not work in this manner. In fact, because the harness of the invention contacts the body of the player only to a limited extent, e.g. along the back and shoulder, no other body parts are needed for support. As a result of this limited contact involving only upper body regions, the invention can be used while a player is seated on a chair. By contrast, the extensive body contact required by Jacobs, involving mid-level body parts, requires that the player be in a standing position to support the instrument.

One method of the invention for balancing an instrument with respect to the body of a player consists of (a) attaching a three-point harness at three distinctive positions to an instrument; and (b) positioning the harness on the body of the player between two of the three points. This is not in the prior art.

In one step of the invention there is positioning of the harness to achieve a balanced orientation of the instrument without requiring applying a countervailing torque. This is not in the prior art.

The instrument of the invention can be a guitar and further include the step of extending the harness about the neck of the player between two points of connection of the strap to the guitar. A further step includes adjusting the harness in relation to an intermediate connection to the instrument.

A further step includes adjusting a loop that forms an intermediate connection and extends around a strap at an intermediate position. The loop can be enlarged or reduced in accordance with the adjustment needed to achieve balance for the instrument relative to the player.

A musical instrument having several portions, each with a separate center of mass, can be combined with a suspension that attaches to two portions, with a further attachment connected to the instrument and confined between the centers of mass of two portions.

DESCRIPTION OF THE DRAWINGS

Other aspects of the invention will become apparent after considering several illustrative embodiments, taken in conjunction with the drawings, in which.

DETAILED DESCRIPTION

Figure 1:
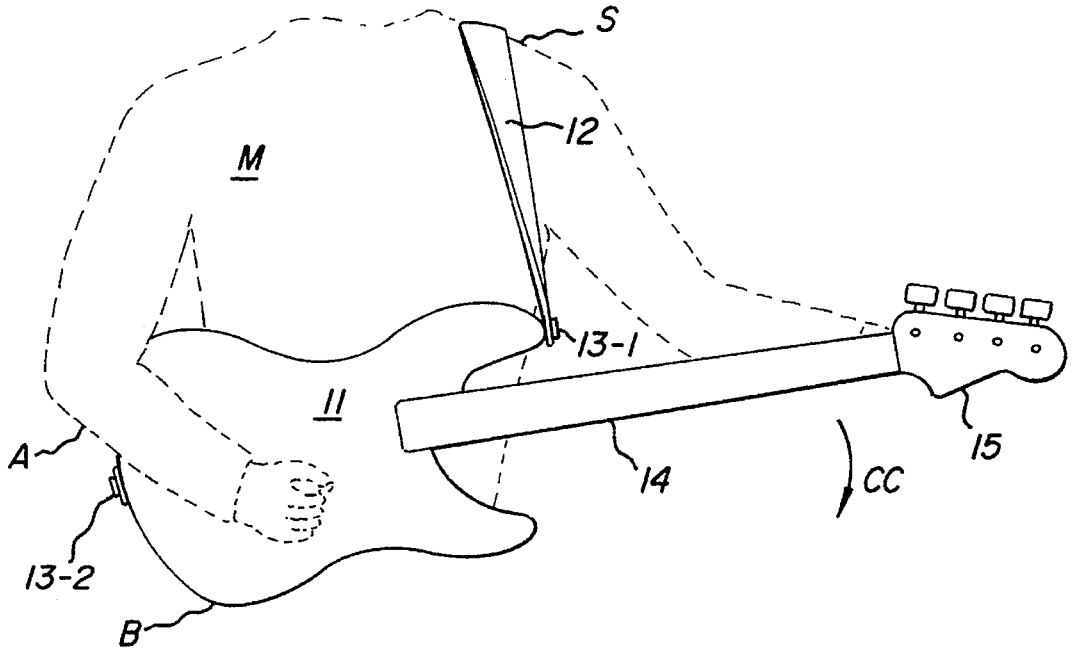
Fig. 1 PRIOR ART
FIG. 1 is a partial frontal view showing a musician with a guitar suspended from his shoulder by a conventional suspension strap of the Prior Art having both its ends attached to the main body of the guitar.

With reference to the drawings, FIG. 1 shows a musician M with a guitar 11 that is suspended by a strap 12 that is attached to the guitar at hook positions 13-1 and 13-2 and extends around the shoulder S of the musician M. The back-side, hidden outline of the strap 12 is shown by dashed lines in FIG. 1. The four strings 16 and four tuning pegs 17 are typical of bass guitars. Because the guitar 11 has an elongated neck 14 that terminates in an enlarged pad 15, the latter applies a torque to the body B of the instrument 11. The resulting torque tends to bring about a clockwise rotation of the instrument 11 in the direction indicated by the clockwise arrow CC. To overcome the torque effect, it is common practice among musicians with such instruments to apply a counterclockwise countertorque with the arm A on the body B. Not only does this add to the fatigue of the player, it can reduce the facility with which the musician is able to manipulate the instrument.

Figure 2:
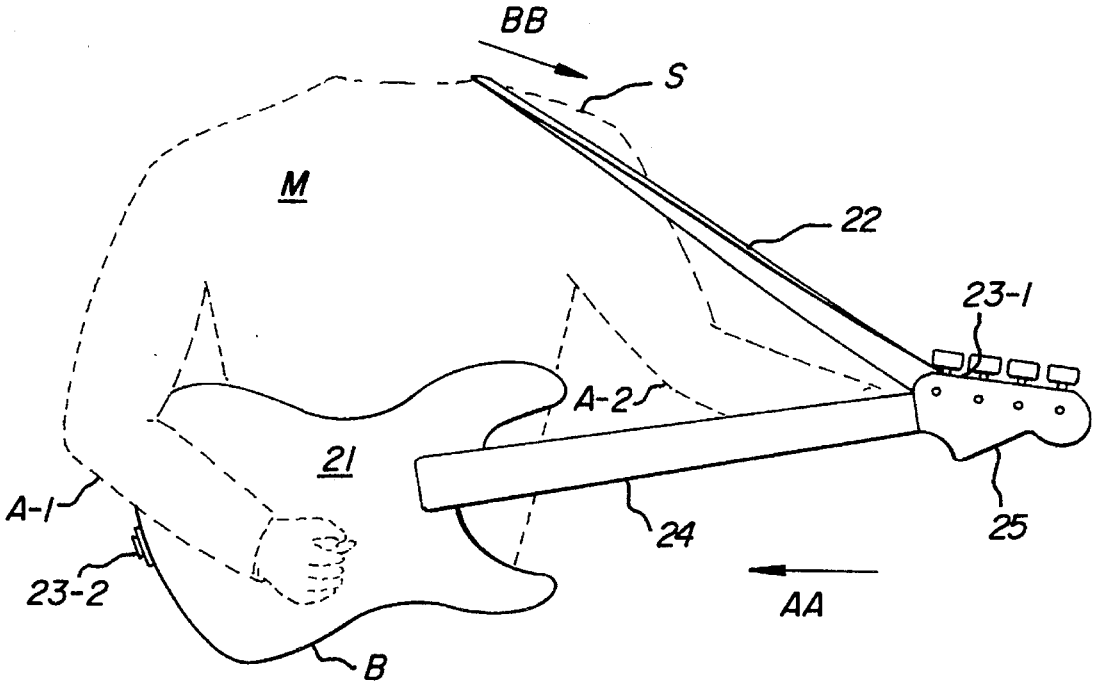
PRIOR ART Fig. 2
FIG. 2 is a partial frontal view showing a musician with a guitar suspended from his shoulder by a conventional suspension strap of the Prior Art, with one end attached to the main body of the guitar and the other end attached to the head pad of the guitar.

FIG. 2 shows a guitar 21 that is suspended by a strap 22, which extends around the shoulder S of the musician M. For clarity, no strings are shown on the instrument. The back-side, hidden outline of the strap 22 is shown by dashed lines in FIG. 2. The guitar 21 is formed by a body B, an elongated neck 24 and an enlarged pad 25. The strap 22 is attached to the guitar at a conventional hook position 23-1 located on, and behind, the enlarged pad 25, and the hook position 23-2 on the body B. The hood position 23-1 on the back-side of pad 25 is shown by dashed lines in FIG. 2. Because of the elongated neck 24, the guitar tends to swing in the direction indicated by the arrow AA. To overcome this swinging tendency, it is common practice among musicians with such instruments to apply a counter force with the arm A-1. Because of the long, unsecured span of the strap 22 between the shoulder S of the musician M and its point of attachment 23-1, and the resulting angle the strap 22 makes with the shoulder S, the weight of the guitar 21 tends to pull the strap 22 off the shoulder S of the musician M in the direction indicated by arrow BB. When manipulation of such instruments requires rapid movement of the arm A-2, the performing musician must often readjust the position of strap 22 on shoulder S. Such compensating activity of the player causes fatigue and can reduce the facility with which the musician is able to manipulate the instrument.

Figure 3:
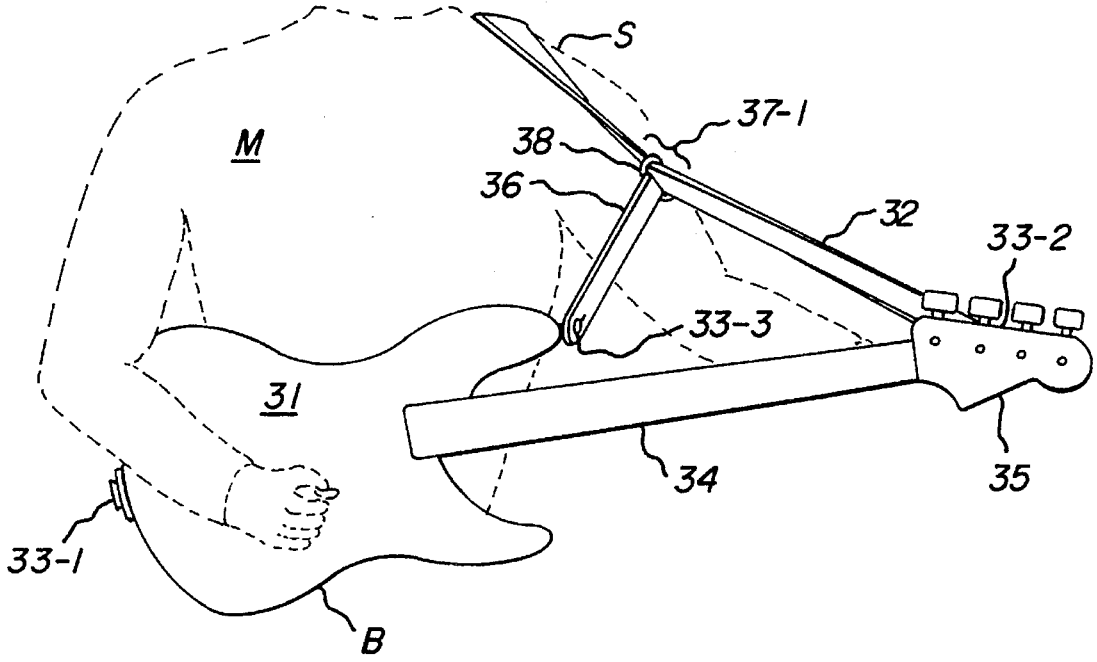
FIG. 3 is a partial frontal view showing the musician of FIGS. 1 and 2 with a guitar suspended from his shoulder using a suspension harness in accordance with the invention.

In order to increase the facility with which a suspended musical instrument can be manipulated, the invention provides a three point harness 30 as shown in FIG. 3 attached to a guitar 31 suspended from the shoulder S of the musician M. For clarity, no strings are shown on the instrument. The three point harness 30 is attached to the guitar 31 at hook positions 33-1, 33-2 and 33-3. The harness 30 contains a strap 32, which has one of its ends attached to the hook position 33-1 at the usual position of attachment on the main body B of the instrument 31. The opposite end of the strap 32 is attached at the usual position of attachment 33-2 behind the enlarged head or pad 35 and near the terminus of the elongated neck 34. The back-side, hidden outlines of the strap 32 and of the hood position 33-2 are shown by dashed lines in FIG. 3. To complete the connection of the strap 32 to the instrument 31, an intermediate attachment 36 extends from an intermediate position 37-1 on the strap 32 to the attachment joint 33-3, near the junction of the body B and the elongated neck 34. The intermediate attachment 36 contacts the strap 32 by means of a ring 38, which loops about the strap 32. Both the length of the intermediate attachment 36 and the location 37-1 where the ring 38 contacts the strap 32 can be adjusted in accordance with the amount of counterbalance and security that is needed for the harness to provide a suitable suspension. These adjustments are facilitated by button 39-1 and the button holes 39-2 of the intermediate attachment 36. In FIG. 3, bracket 37-1 shows the range of length along strap 32 the ring 38 may contact the strap 32.

Figure 4:
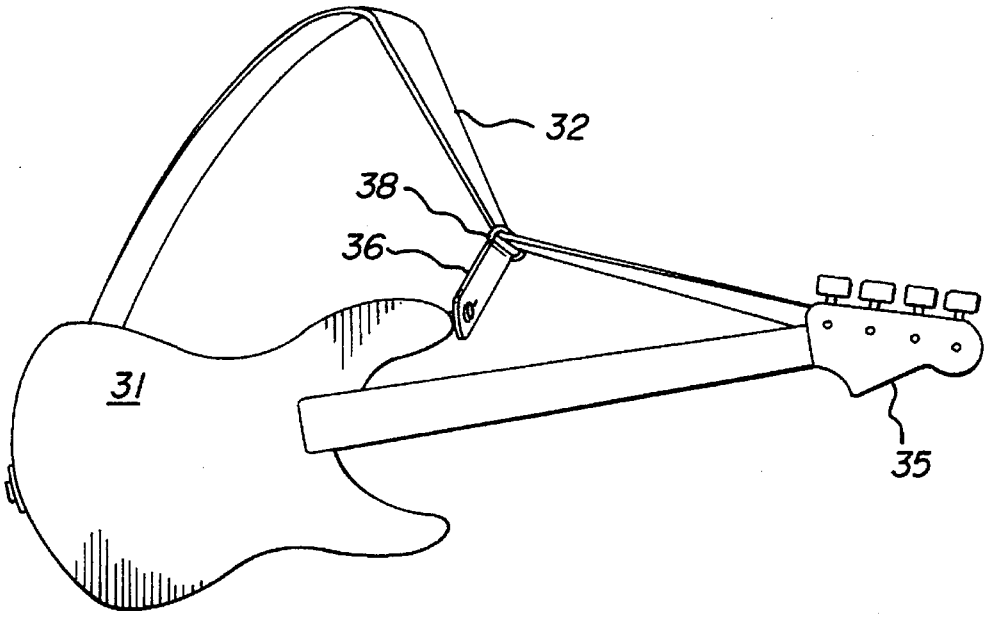
FIG. 4 is a view illustrating the adjustment of the suspension harness of FIG. 3 using a loop intermediate connection.

FIG. 4 shows details for attachment of the suspension harness 30 to the guitar 31 of FIG. 3. For clarity, no strings are shown on the instrument, and the harness 30 is shown loosely connected to the guitar 31, without being suspended from the shoulder of the musician M. FIG. 4 illustrates adjustment of the harness 30, with the length of the intermediate attachment 36 less than that illustrated in FIG. 3, and with a smaller portion of strap 32 contained between the attachment 33-2 and ring 38 than that illustrated in FIG. 3.

Figure 5:
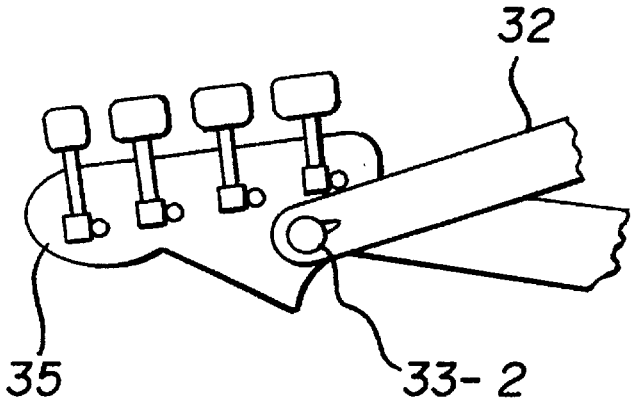
FIG. 5 is a back-side view of the head of the guitar of FIG. 3, showing one of the attachments of the suspension harness.

FIG. 5 is a back-side view detailing the attachment 33-2 of the strap 32 to the back of the head 35 of the guitar 31 of FIG. 3.

It will be understood that the foregoing embodiments are for illustration only and that other adaptations and aspects of the invention will be readily apparent to those of ordinary skill in the art. It will be appreciated that the musical instrument can be a guitar with a resonant chamber joined to a head end by a stringed neck.

What is claimed:

1. Apparatus for the suspension of a musical instrument, which includes a main body and a head connected to said main body, comprising a strap having opposite ends;

first means for attaching one of said opposite ends of said strap to the main body;

second means for attaching another of said opposite ends of said strap to the head connected to said main body; and means intermediate said first means and said second means attached to said strap between said opposite ends at a position displaced from said first means for limiting the extent to which said strap can be displaced from the body of the instrument.

2. Apparatus as defined in claim 1 wherein said instrument is a guitar having said main body and a neck connected to and extending from said body to said head attached to said neck remote from said body, and said strap is attached at said one of said opposite ends to said head of said instrument and at the another of said opposite ends to a portion of said main body remote from said head.

3. Apparatus as defined in claim 2 wherein the intermediate means is attached to said main body in the vicinity of the connection of said main body to said neck.

4. Apparatus as defined in claim 1 wherein said strap has width and a thickness which is less than said width and the attachings of the firsts, second and intermediate means being removable.

5. A method of balancing an instrument with respect to a player having a body, which comprises the steps of:

(a) attaching a harness having three-points at three distinctive and separated positions to said instrument; and (b) positioning said harness on said body of said player between two points of said three points.

6. The method of claim 5 further including the step of positioning said harness to achieve a balanced orientation of said instrument without applying a countervailing torque to said instrument.

7. The method of claim 6 wherein said instrument is a guitar and said player has a neck extending from said body, further including the step of extending said harness about the neck of the player between two of said separated points of connection of said harness to said guitar.

8. The method of claim 5 including the further step of adjusting said harness in relation to said two points of connection to said instrument.

9. The method of claim 8 wherein a second of said two points of connection forms a loop, further including the step of adjusting said loop that is a portion of said harness.

10. The method of claim 9 further including the step of enlarging or reducing said loop to achieve balance for said instrument relative to the player.

11. The combination of a musical instrument having first and second portions and means for suspending said instrument comprising: first and second attachments connected to a first and second one of said portions, respectively; and a further attachment connected to said instrument separate from said first and second attachments for suspension therefore.

12. The combination as defined in claim 11 wherein said instrument comprises an elongated neck and said further attachment is connected to said instrument between one of said portions and said elongated neck.

13. The combination as defined in claim 12 wherein one of said portions of said instrument comprises a main body and another of said portions comprises a head affixed at one end to said elongated neck.

14. The combination as defined in claim 13 wherein said musical instrument is a guitar with said main body joined to said head by said elongated neck and said further attachment supports said instrument in tension.

15. The combination as defined in claim 14 wherein the suspension means comprises a strap with one end attached to said instrument, an opposite end attached to said head, and said further attachment being an intermediate portion of said strap attached proximate said neck.

16. The combination as defined in claim 15 wherein said neck and said head form a junction, said one end of said strap attached to said instrument is at an extremity thereof most remote from said head and said opposite end of said strap attached to said head is at the junction with said neck.

17. The combination as defined in claim 13 wherein said means for suspending comprises a strap with an intermediate portion attached between said neck and said body by said further attachment comprising a loop attached proximate between said body and said neck.

18. The combination as defined in claim 17 wherein said loop has a circumference and is adjustable by changing the circumference of said loop.

* * * * *